United States Patent [19]

Rush

[11] 4,019,492

[45] Apr. 26, 1977

[54] METHOD AND APPARATUS FOR AUTOMATIC FURNACE

[76] Inventor: Joseph A. Rush, 26121 Cornor Drive, Damascus, Md. 20750

[22] Filed: Feb. 4, 1975

[21] Appl. No.: 547,085

[52] U.S. Cl. ..... 126/121; 236/11; 237/51; 126/163 R

[51] Int. Cl.[2] ..... F24B 7/04

[58] Field of Search ..... 126/110 R, 110 B, 121, 126/120, 164, 165, 112, 163; 110/72 B; 236/10, 11; 237/51; 431/75

[56] References Cited

UNITED STATES PATENTS

| | | | |
|---|---|---|---|
| 969,669 | 9/1910 | Stewart | 236/10 |
| 1,583,238 | 5/1926 | Scudder | 236/11 X |
| 1,589,539 | 6/1926 | Marchessault | 126/121 |
| 1,751,944 | 3/1930 | Noll | 236/10 |
| 2,579,507 | 12/1951 | MacChacken | 126/110 R X |
| 3,269,383 | 8/1966 | Maasberg | 126/163 X |
| 3,830,218 | 8/1974 | Shelton | 126/164 |
| 3,880,141 | 4/1975 | Abshear | 126/121 |
| 3,942,509 | 3/1976 | Sasser | 237/51 X |

FOREIGN PATENTS OR APPLICATIONS

| | | | |
|---|---|---|---|
| 731,537 | 6/1955 | United Kingdom | 126/164 |

*Primary Examiner*—William E. Wayne
*Assistant Examiner*—William E. Tapolcai, Jr.
*Attorney, Agent, or Firm*—Gerald L. Lett

[57] ABSTRACT

A furnace and method of operation are disclosed for the efficient, controlled combustion of a combustible material such as wood, coal, etc. The furnace includes a grate which grate permits a large amount of combustible material to be stacked within the grate and to be constantly compressed to insure efficient combustion. The furnace also includes a heat exchanger surrounding the grate, which heat exchanger is comprised of an intake jacket and an exhaust jacket disposed on opposite sidewalls of the furnace. The heat exchanger also includes a plurality of heat exchange tubes disposed above and behind the grate and connecting the jackets. Air is drawn into one of the jackets, is directed through the heat exchange tube where the air is heated, and is exhausted through the other jacket. A portion of the heat exchanger intake air is diverted through a perforated air delivery tube disposed adjacent to the grate to provide combustion air for the combustible material. A combustion control system is provided wherein the fire is quenched whenever over-temperature conditions are reached. The combustion control system also includes adjustment of the amount of combustion air directed through the perforated air delivery tube and operating in response to predetermined furnace temperatures. The furnace also includes a novel automatic control system and humidifier apparatus.

21 Claims, 14 Drawing Figures

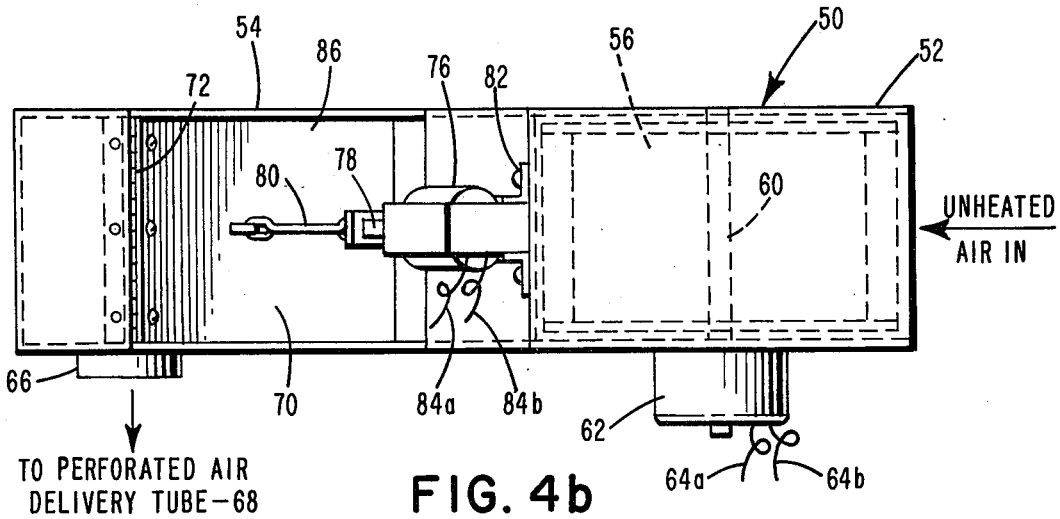
FIG. 4b
FIG. 4a
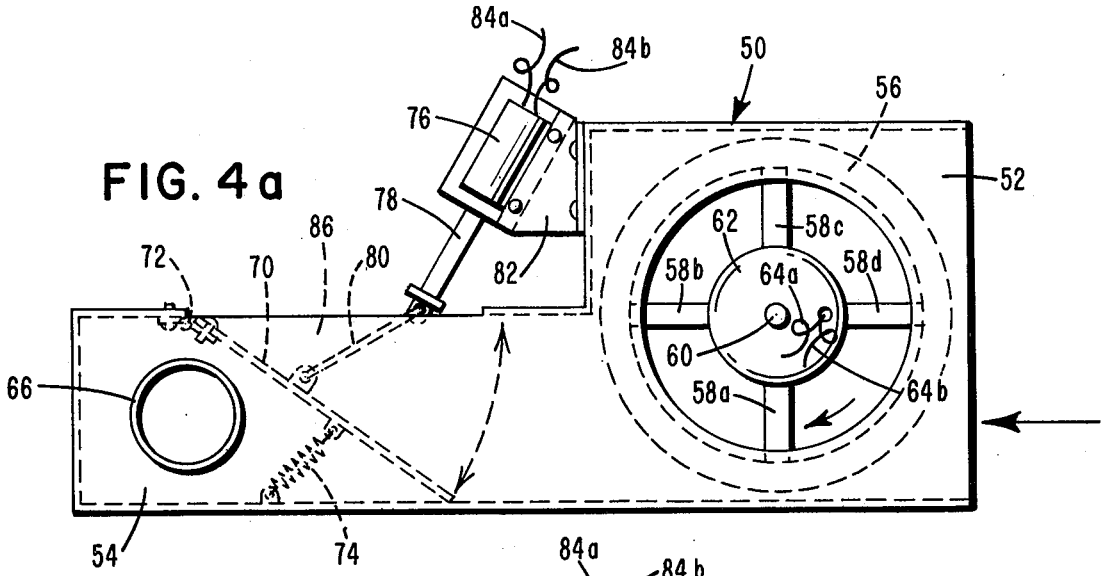
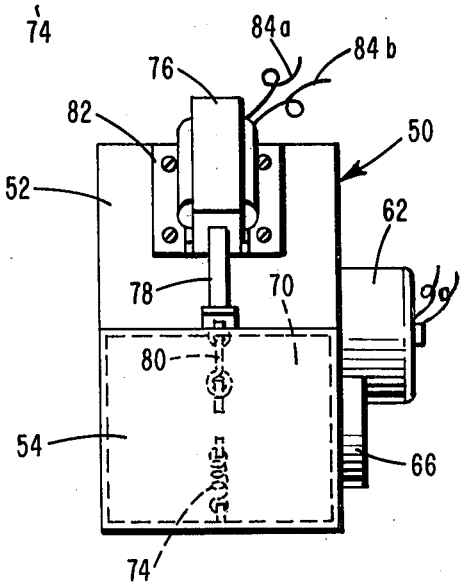
FIG. 4c

METHOD AND APPARATUS FOR AUTOMATIC FURNACE

BACKGROUND OF THE INVENTION

1. Field of the Invention

The invention relates to furnaces and, more particularly, to a method and apparauts for controlling combustion primarily through regulation of combustion air.

2. Description of the prior art

In the furnace art, it is well known to provide a heat exchanger disposed within a fireplace for receiving heat from the combustion of a solid combustible material such as wood. Unheated air drawn into the heat exchanger is heated and is then discharged into the room to more effectively heat the room. Although this is an obvious improvement over a fireplace having no such heat exchanger, much potentially recoverable energy nevertheless is wasted due to lack of control over the rate of combustion of the combustible material. Prior art attempts to control the rate of combustion have commonly involved the use of doors attached to the front of the fireplace which render the fireplace substantially airtight. In connection therewith, a system of manually actuated dampers is provided adjacent to the doors for regulating the flow of combustion air entering the fireplace. Although such a combustion airflow regulation system in combination with a heat exchanger is superior to a fireplace having only a heat exchanger, obvious difficulties are presented when different combustible materials having varying rates of combustion are employed in the fireplace. Thus, regulation of the rate of combustion is usually troublesome, time consuming and inefficient. It has been discovered that in order to effectively control the burning rate of a solid combustible material, some control must be exercised over the arrangement, or stacking of the combustible material. Prior art grates have failed to do little more than provide a receptacle for the mere deposit of combustible material.

Additional problems exist with conventional heat exchangers. For example, the heat exchanger may be provided with a fan, controlled either manually or thermostatically. Such a fan improves the room heating qualities of the heat exchanger, but with wide variances in heat output. That is, the heat output may be improved with a fan, but temperature variations still will occur because of the varying rate of combustion. Another problem with prior art heat exchangers is the lack of a capability to effectively humidify the heated output air. Attempts at humidification generally have taken the form of a pan of water disposed in the exhaust side of the heat exchanger. This obviously is a crude and inefficient way to humidify the heated air. Yet another problem has been where the combustion process proceeds extremely rapidly. In such a case, such potentially recoverable energy is lost and the combustible material soon is exhausted. It is even possible for furnace temperatures to rise to such a level that components of the heat exchanger are damaged.

Accordingly, it is an object of the invention to efficiently regulate the rate of combustion of combustible material in a furnace.

It is another object of the invention to accomplish such regulation either manually or automatically.

It is a still further object of the invention to provide a new and improved furnace having enhanced combustion and heat transfer efficiency over prior art furnaces.

It is yet another object of the invention to provide a new and improved furnace wherein the heat output of the furnace may be maintained substantially constant.

It is another object of the invention to provide a new and improved furnace wherein heated air exhausted into the room may be efficiently humidified.

It is still another object of the invention to provide a new and improved furnace wherein overtemperature conditions within the furnace may be prevented.

SUMMARY OF THE INVENTION

In carrying out the invention to achieve the aforementioned and other objects, a furnace and method of operation are disclosed for the efficient, controlled combustion of a combustible material such as wood, coal, etc. and for the maintenance of a high, constant heat output. The furnace includes a grate, which grate permits a large amount of combustible material to be stacked within the grate and to be constantly compressed to insure efficient combustion. The furnace also includes a heat exchanger surrounding the grate, which heat exchanger is comprised of an intake jacket and an exhaust jacket disposed on opposite sidewalls of the furnace. The heat exchanger also includes a plurality of heat exchange tubes disposed above and behind the grate and connecting the jackets. Air is drawn into one of the jackets, is directed through the heat exchange tubes where the air is heated, and is exhausted through the other jacket. A portion of the heat exchanger intake air is diverted through a perforated air delivery tube disposed adjacent the grate to provide combustion air for the combustible material. A combustion control system is provided wherein the fire is quenched whenever overtemperature conditions are reached. The combustion control system also includes adjustment of the amount of combustion air directed through the perforated air delivery tube and operating in response to predetermined furnace temperatures. The furnace also includes a novel automatic control system and humidifier apparatus.

DESCRIPTION OF THE DRAWING

The principles of the invention will be more readily understood by reference to a description, given below, of a preferred embodiment constructed according to those principles along with the drawings which are briefly described as follows.

FIGS. 4*a*, 4*b*, and 4*c* are orthogonal views depicting a portion of the ductwork of the invention.

DESCRIPTION OF THE PREFERRED EMBODIMENT

Figure 1:
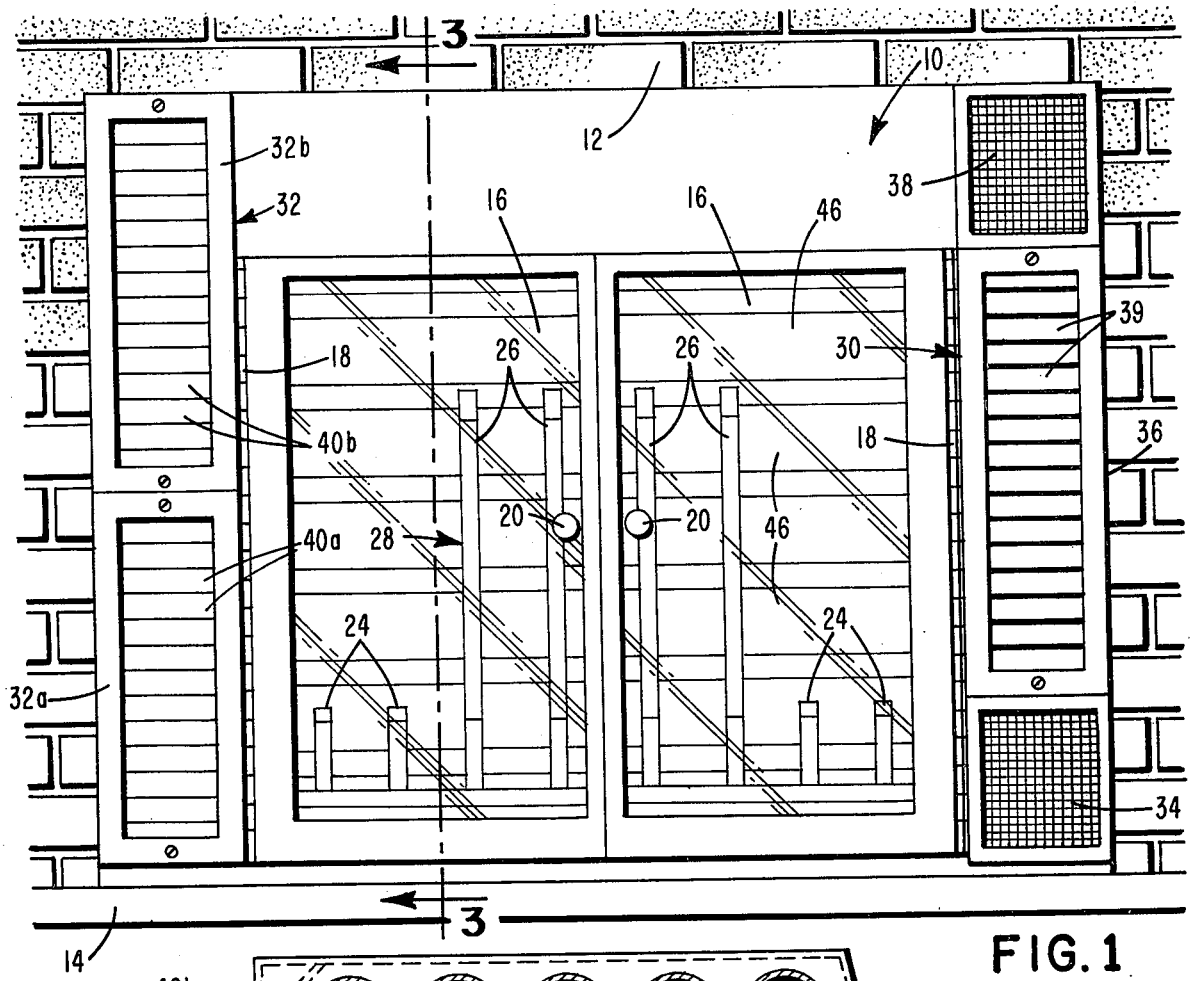
FIG. 1 is a front elevational view of a furnace according to the invention installed in a fireplace.

FIG. 1 shows external portions of a furnace 10 according to the invention. Furnace 10 may be used in many environments, if desired. However, the structure and advantages of the invention are particularly well-suited for use in a fireplace, and thus it will be described in such an environment.

Furnace 10 is enclosed in a conventional brick fireplace structure 12 which includes a suitable hearth 14. Furnace 10 may be permanently installed within the fireplace, as when constructing a new house, or furnace 10 may be installed at a later date, merely by sliding furnace 10 into an already existing fireplace.

The external portions of furnace 10 comprise a pair of doors 16. Doors 16 are hingably attached to furnace 10 by hinges 18, which hinges may be of any well known type. Doors 16 also include suitable handle members 20 for conveniently opening and closing doors 16. It is desired, although not necessary, that doors 16 be formed of a transparent substance, such as heat-tempered glass. The attractiveness of the furnace is enhanced by such a construction, in addition to permitting radiant energy to enter the room within which fireplace furnace 10 is disposed. It is pointed out that doors 16, when fully closed, render the front, central portion of fireplace furnace 10 substantially airtight.

A plurality of heat exchange tubes 46 also is shown in FIG. 1. Heat exchange tubes 46 will be described in detail hereinafter. Additionally, upstanding portions 24 and 26 of a fireplace grate 28 are shown in FIG. 1. Details of grate 28 will be described hereinafter.

The front portion of furnace 10 includes cold air intake jacket cover 30 and hot air exhaust jacket cover 32. Cover 30 is divided into three parts: lower portion 34 comprises an air intake for certain portions of furnace 10; central portion 36 comprises an air intake for certain other portions of furnace 10; and upper portion 38 comprises a cover concealing certain of the furnace controls as well as a portion of the furnace hot air exhaust system.

Cover 32 is formed in two parts: lower portion 32*a* and upper portion 32*b*. Portions 32*a* and 32*b* are identical and may be interchanged if desired. Central portion 36 of cover 30 and portions 32*a* and 32*b* of cover 32 are attached to furnace 10 by any well known means such as screws. Central portion 36 additionally includes a plurality of louvers 39. Louvers 39 are directed downwardly into furnace 10 to more effectively convey unheated air into furnace 10. In a similar manner, portions 32*a* and 32*b* of cover 32 include a plurality of louvers 40*a* and 40*b*. Louvers 40*a* and 40*b* are arranged to direct heated air exhausted through cover 32 upwardly into the room.

Figure 3:
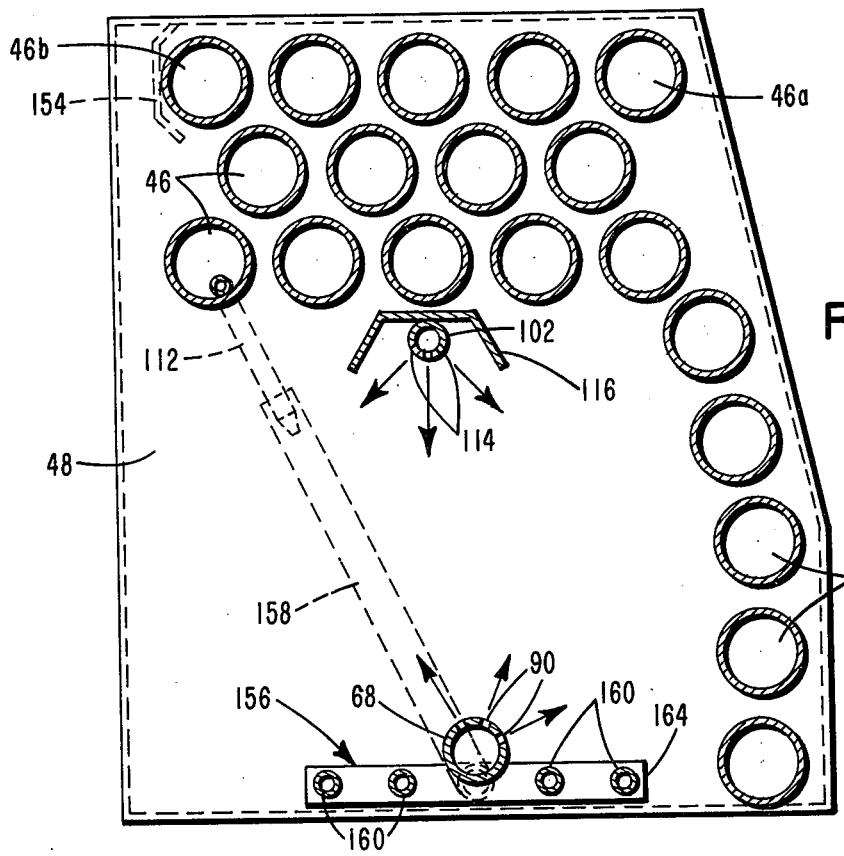
FIG. 3 is a cross-sectional view, taken along line 3—3 of FIG. 1.
Figure 2:
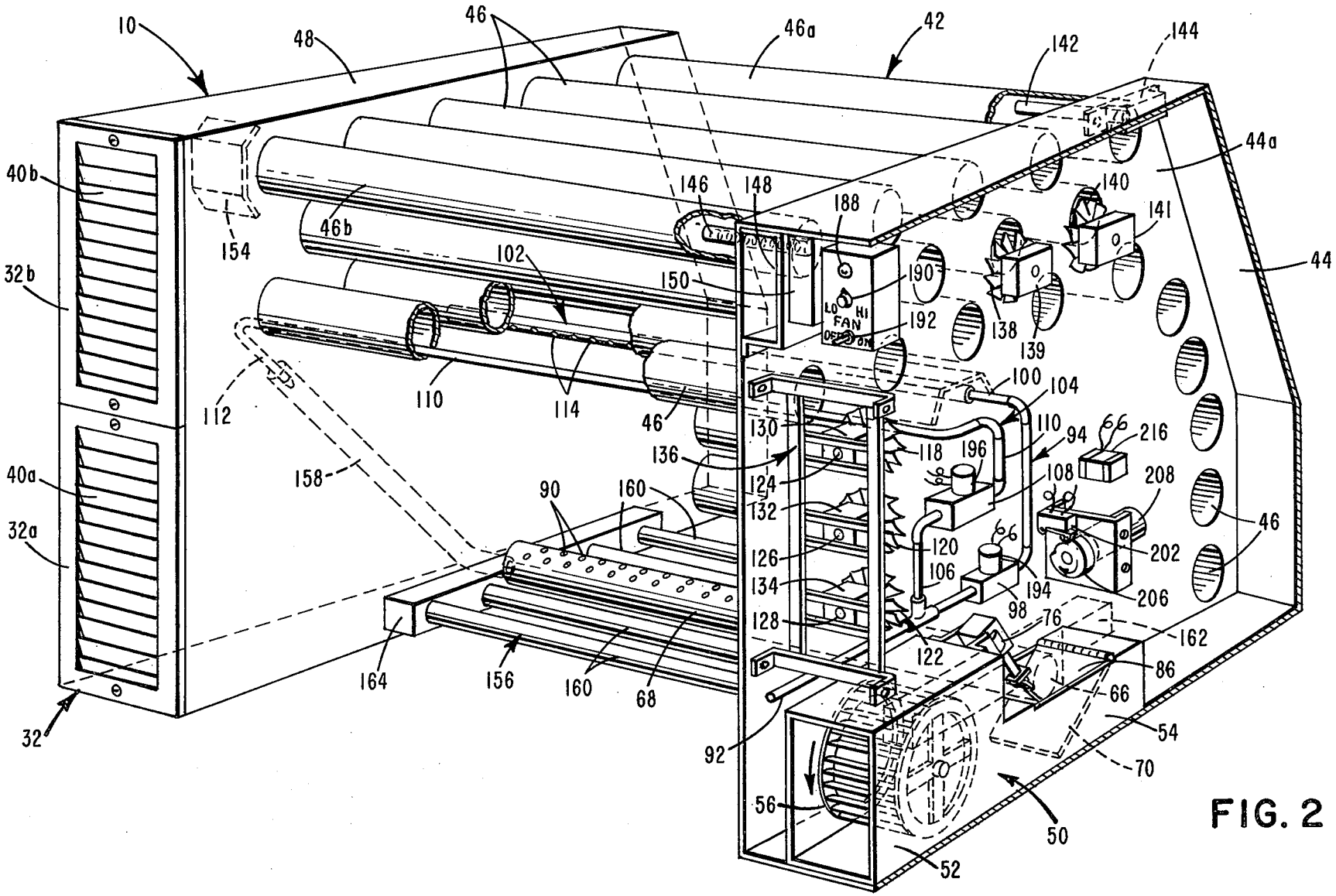
FIG. 2 is a perspective view, partly in section, of one form of the furnace according to the invention.

FIG. 2 shows furnace 10 prior to installation in the fireplace. Furnace 10 comprises a heat exchanger 42 having a cold air intake jacket 44, a plurality of heat exchange tubes 46, and a hot air exhaust jacket 48. when installed in a fireplace, it is desirable that jacket 44 be disposed adjacent one sidewall of the fireplace and jacket 48 be disposed adjacent the opposite sidewall of the fireplace. Heat exchange tubes 46 connect jackets 44 and 48 to permit airflow therebetween. Additionally, heat exchange tubes 46 extend above and behind grate 28 (FIGS. 5*a*–5*d*). as shown in FIGS. 2 and 3, nineteen heat exchange tubes 46 are employed as part of the invention. This number of tubes, however, is not important to the invention, provided that an adequate airflow and heat transfer relationship can be established with another number of heat exchange tubes.

As illustrated, heat exchange tubes 46 are of conventional design. They are formed of sheet metal and are approximately 3 inches in diameter. It is noted that the use of conventional heat exchange tubes is not required, although such tubes may be more economically practical. If it is desired to improve the heat transfer capabilities of the heat exchanger, heat exchange tubes 46 may be provided with indentations or tab-like extensions (not shown) in order to increase the turbulence of the airflow around the tubes. Further, heat exchange tubes 46 may be formed in a serpentine shape or in a zigzag shape. As with heat exchange tubes 46, jackets 44 and 48 preferably are formed of sheet metal, although other materials may be used if desired. Additionally, for greater protection of the operating elements and controls disposed within jacket 44, a layer of heat resistant material, such as asbestos, may be attached to inner wall 44*a* of jacket 44.

A duct means 50 is disposed within the lower portion of cold air intake jacket 44. Duct means 50 is formed of a first, box-like portion 52 and a second, smaller, box-like portion 54. Portion 52 mates with lower portion 34 of cover 30 to form a part of the cold air intake system.

Referring to FIGS. 4*a*–*c*, a fan 56 is disposed within portion 52. Fan 56 is mounted for rotation within portion 52 by structural members 58*a*, 58*b*, 58*c*, and 58*d*. As illustrated, fan 56 is known as a squirrel cage fan, although any other well known, commercially available fan may be used. Fan 56 is mounted on shaft 60, which shaft is driven by fan motor 62. Electrical leads 64*a* and 64*b* extend from fan motor 62. When fan 60 is in operation, unheated air is drawn through portion 52 and is forcibly directed into portion 54, as will be explained in detail hereinafter. An opening 66 is formed in that wall of portion 54 proximate inner wall 44*a*. A perforated air delivery tube 68 (FIG. 2) is fitted tightly into opening 66 so that minimal air leakage can occur.

In order to regulate the airflow to perforated air delivery tube 68, a damper means; 70 is hingably mounted for movement within portion 54 by hinge means 72. Damper 70 is biased to that position shown in FIG. 4*a* by a restoring means, such as spring 74. An activating means, such as solenoid 76 having a piston 78 extending therefrom is provided to displace damper 70 against the spring bias. A connecting link 80 connects damper 70 and piston 78 of solenoid 76 to accomplish such displacement.

Solenoid 76 is restrained from movement by a frame member 82. Frame member 82, in turn, is rigidly affixed to portion 52 of of duct means 50. This is accomplished by any well known attachment means, such as sheet metal screws. A pair of electrical leads 84*a* and 84*b* extend from solenoid 76 to control operation of solenoid 76.

An opening 86 is formed in upper wall 88 of portion 54. Opening 86 is substantially coextensive with the area presented by damper 70 when damper 70 is in the raised position. Thus, opening 86 may be substantially closed when damper 70 has been raised by solenoid 76. Referring to FIG. 4*a*, it will be seen that when solenoid 76 is energized, damper 70 will be caused to rotate counterclockwise to block opening 86, and thus prevent the passage of air therethrough. When solenoid 76 is deenergized, spring 75 causes damper 70 to rotate clockwise to that position shown in FIG. 4*a* to prevent air from flowing through opening 66.

It is to be emphasized that damper 70 and the associated structure of portion 54 may be formed in any configuration so long as the airflow can be effectively adjusted between openings 66 and 86. For automatic operation of damper 70, it is necessary to use solenoid 76 or its equivalent. However, if desired, damper 70 may be manually controlled. This can easily be accomplished by replacing connecting link 80 with a chain and extending the chain to an external portion of fireplace furnace 10. This type of alternate control for damper 70 is a common expedient, and consequently is not illustrated.

An additional part of the combustion control system comprises perforated air delivery tubes 68. As illustrated in FIGS. 2 and 3, perforated air delivery tube 68 is disposed near the bottom of fireplace 12 and extends from opening 66 in duct means 50 laterally across the fireplace to an area proximate hot air exhaust jacket 48. Air devliery tube 68 is provided with a plurality of perforations 90. Perforations 90 are preferably approximately ⅜ of an inch in diameter, and are thus easily formed in air delivery tube 68, which is comprised of sheet metal. Perforations 90 are so constructed and arranged so as to provide a lesser airflow through that portion of perforated air delivery tube 68 proximate cold air exhaust jacket 48. As presently practiced, this is achieved by forming a lesser number of perforations 90 closer to jacket 44 and a greater number of performations 90 closer to jacket 48. However, the same airflow result could be achieved with equal spacings of perforations 90 merrely by forming larger perforations in that section of perforated air delivery tube 68 proximate jacket 48. The result of this airflow adjustment through perforated air delivery tube 68 is the jacket 44 is kept at a lower temperature than jacket 48. This is necessary because jacket 44 contains most of the operating elements of furnace 10 and the controls associated therewith. Thus, the resultant lowered temperature within jacket 44 insures long life and reliability for these elements and controls.

It will be noted that all of the combustion air flows through perforated air delivery tube 68. In order to provide efficient, uniform combustion of combustible materials, it is necessary that the combustion air flow to all portions of the combustible material deposited on grate 28. To accomplish this result, perforations 90 are formed at several radial locations, as shown in FIG. 3. The exact angular displacement of perforation 90 may be adjusted to suit the airflow requirements of different combustible materials. If desired, the operator of furnace 10 could employ a different perforated air delivery tube 68, having different patterns of perforations 90, in order to efficiently burn different types of combustible materials. For example, if wood is to be burned, a smaller angular displacement of perforations 90 is possible because, even when compressed, rather larger air gaps still will be left in the wood. However, if coal is to be burned, a greater angular displacement of perforations 90 is preferred, in order to direct air to all portions of the more tightly packed coal.

By judiciously selecting the anuglar displacement of those perforations 90 directed toward doors 16, a surprising result can be achieved. These perforations will set up an air curtain tending to keep flames and combustion gases from the doors. This not only prevents the doors, if they are glass, from being broken, but also tends to keep the doors clean. Additionally, as mentioned previously, the resultant uniform airflow distribution enhances efficient combustion of the combustible material.

An additional portion of the combustion control system is illustrated in FIGS. 2 and 3. Due to the extremely efficient combustion system of the present invention, it is a distinct possibility that temperatures within fireplace furnace 10 may rise to unacceptable limits. Thus, it may be necessary to suddenly reduce the rate of combustion whenever a predetermined maximum fireplace temperature has been reached. This is accomplished, in the embodiment illustrated, by means of a water quench. A water pipe 92 is attached to any convenient, conventional water supply. Water pipe 92 is divided into two elements: a first water line 94 comprised of portion 96, a first valve 98, a portion 100 disposed within jacket 44, and a perforated water line 102 extending from jacket 44 laterally above grate 28 to a position proximate jacekt 48; and a second water line 104 comprised of portion 106, second valve 108, a portion 110 disposed within jacket 44 and extending through one of the heat exchange tubes 46 to an outlet portion 112, which outlet portion 112 is disposed within exhaust jacket 48. If desired, outlet portion 112 may be provided with an orifice to limit the amount of water which can flow through second water line 104.

Perforated water lines 102 of first water line 94 is provided with a plurality of perforations 114 similar in construction and arrangement to perforations 90 of perforated air delivery tube 68. When valve 98 is opened to permit water to flow through first water line 94, a greater amount of water is directed onto the combustible material near that portion of the combustible material disposed proximate jacket 44 and a lesser amount of water is directed onto the combustible material near that portion of the combustible material disposed proximate jacket 48. As with perforations 90, perforations 114 are radially displaced to provide a uniform, dispersed flow of water to quench the fire. An additional feature of portion 102 of first water line 94 is that, when viewed from the front as in FIG. 1, portion 102 slopes upwardly from right to left. This tends to increase the water pressure in that part of portion 102 proximate jacket 44 in order to provide a greater dispersement of water for an enhanced cooling effect. Further, any water remaining in water line 94 after activation thereof, tends to drip onto the fire near jacket 44 to provide further protection for the elements and controls disposed therein.

As illustrated in FIG. 3, portion 102 with perforations 114 therein effectively quenches the fire whenever such a quenching is required. However, it will be apparent that water flowing out of portion 102 through those perforations 114 directed toward doors 16 may inadvertently cause water to be splashed on doors 16. It is conceivable that doors 16 could be cracked upon activation of the water quench if doors 16 were comprised of glass. Thus, an alternative embodiment of portion 102 comprises a hood-like member 116, which hood member is disposed outwardly and downwardly about perforations 114 so as to shield doors 16. As with most of the other components of furnace 10, member 116 is formed of sheet metal and is easily attached to portion 102 by any well known means, such as spot-welding, clamping or bolting.

It is to be understood that quenching of the fire could be accomplished by means other than the water quench system described and illustrated herein. For example, a conventional fire extinguisher could be disposed within jacket 44, which fire extinguisher could be actuated by, for example, a thermostatically responsive solenoid. An additional example of such an alternative water quench system could be the use of a chemical fire suppressant, such as bicarbonate of soda. The chemical preferably would be dispersed in powder form from convenient locations in jacket 44. This could easily be done by fan blades such as those commonly employed in grass seed spreaders.

A froced air system is provided as part of the present invention. Referring to FIG. 2, fans 118, 120, and 122 are disposed within jacket 44 immediately behind central portion 36 of cover 30. As illustrated, fans 118, 120, and 122 are identical, commercially available ten-bladed fans, each driven on identical shafts 124, 126, and 128 by motors 130, 132, and 134. Each fan is mounted through its associated fan motor to a bracket structure 136. Bracket structure 136, in turn, is mounted within jacket 44 by an conventional means such as sheet metal screws. Bracket structure 136 is itself most conveniently formed of sheet metal strips. Fans 118, 120, and 122 are directed rearwardly, so as to force incoming air to the rear of jacekt 44.

Additional components of the forced air system include fans 138 and 140. Fans 138 and 140 are identical to fans 118, 120, and 122, and are driven by fan motors 139 and 141, respectively. However, instead of being directed rearwardly, fans 138 and 140 are directed laterally so as to force incoming air directly through heat exchange tubes 46. Due to their location, fans 138 and 140 do not require a separate bracket structure, but rather are mounted directly to jacket 44.

It is emphasized that the precise number, location and orientation of the illustrative fans is not critical to effectively practice the invention. It is contemplated that a single, large fan similar to fan 56 might be employed in place of the presently illustrated fans 118, 120, 122, 138, and 140.

In order to control the operation of the previously mentioned elements, a control system is provided. The control system includes a first thermostat 142, which thermostat extends longitudinally into heat exchange tube 46*a*. Thermostat 142 preferably is a bimetal type thermostat mounted for displacement within a housing 144. Housing 144, in turn, is rigidly affixed to jacket 44. A second thermostat 146 extends longitudinally into another of the heat exchange tubes 46*b*. Second thermostat 146 preferably is of the helical type adapted for axial displacement. Thermostat 146 is supported by bracket 148, which bracket in turn is rigidly affixed to jacket 44. Mounted to bracket 148 on the opposite side of thermostat 146 is a housing 150. A cam 152 (FIG. 7) is operatively connected to thermostat 146 and is disposed within housing 150. Upon displacement of thermostat 146, cam 152 is caused to rotate, resulting in a control function as will be described hereinafter.

Figure 6A:
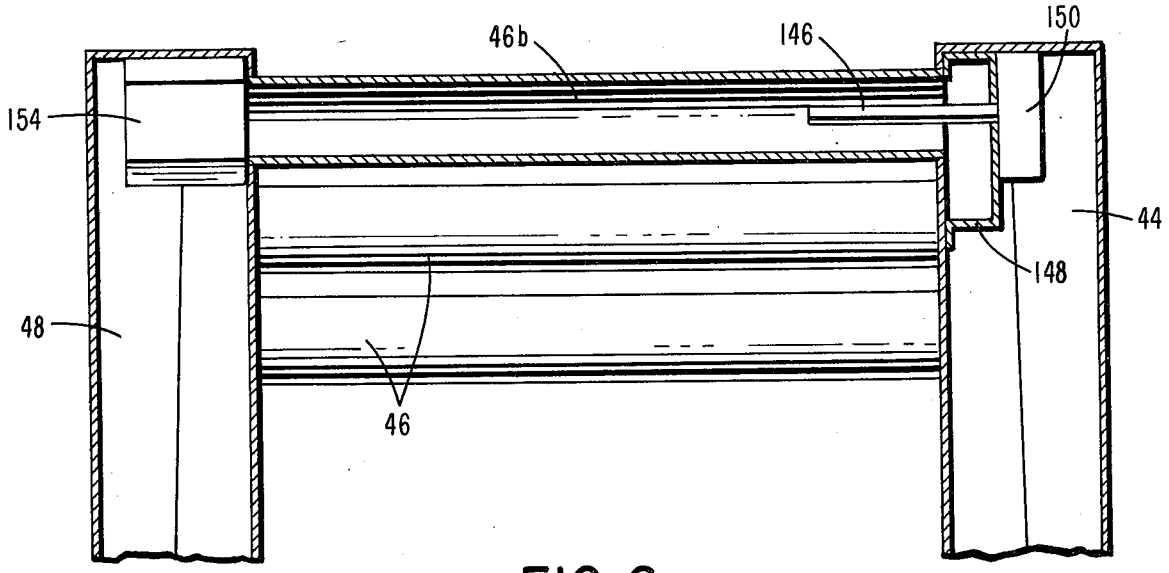
FIGS. 6*a* and 6*b* are front elevational and plan views, respectively, of portions of the furnace according to the invention.
Figure 6B:
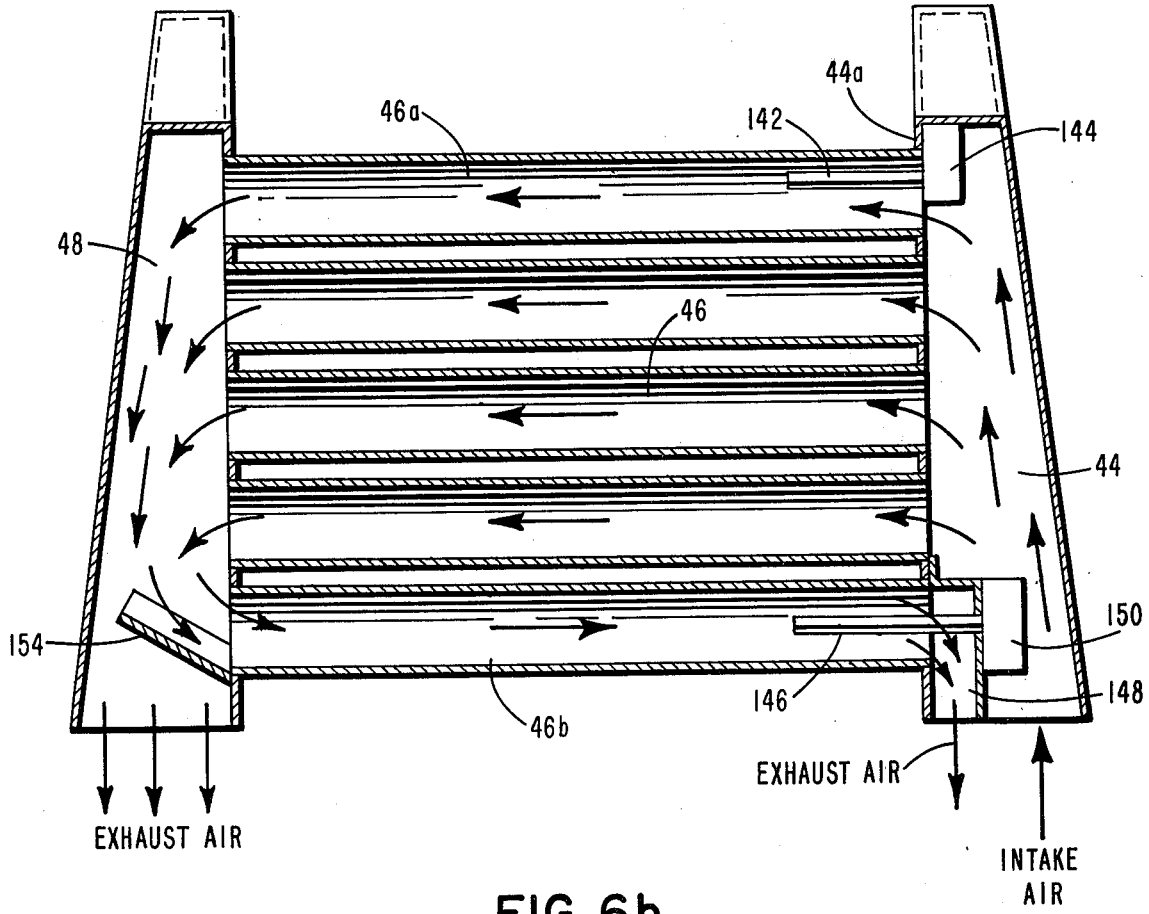

Since thermostat 146 is disposed within heat exchange tube 46*b*, thermostat 146 will not be directly affected by temperatures existing within the fireplace. Thus, a portion of the heated exhaust air is diverted from hot air exhaust jacket 48, through heat exchange tube 46*b*, past thermostat 146 and thence outwardly into the room. This is accomplished by mean of the deflector 154. Deflector 154 is formed of sheet metal and is rigidly affixed to inner surface 48*a* of jacket 48 by any well known attachment means such as sheet metal screws. Deflector 154 is located forwardly of heat exchange tube 46*b* in order to effectively direct heated exhaust air into heat exchange tube 46*b*. The precise configuration of deflector 154 is unimportant, so long as the function of deflecting heated air into heat exchange tube 46*b* is achieved. It is seen that the flow of air through heat exchange tube 46*b* is countercurrent to that through the other heat exchange tubes 46, including heat exchange tube 46*a*. Thus, a separate outlet for the air flowing through heat exchange tube 46*b* is required. Referring to FIGS. 6*a*, 6*b*, and FIG. 1, this is accomplished by disposing bracket 148 immediately adjacent upper portion 38 of cover 30. Bracket 148 is thus seen to direct heated air from heat exchange tube 46*b* outwardly into the room through a part of portion 38 of cover 30. Incoming unheated air forcibly directed through jacket 44 is prevented from entering heat exchange tube 46*b* partially due to the location of heat exchange tube 46*b* in the front, upper portion of jacket 44. Additionally, bracket 148 provides a barrier to incoming, unheated air to prevent the mixing thereof with heated exhaust air flowing through heat exchange tube 46*b*.

The fireplace furnace of the present invention also is provided with a humidifier. A portion of the humidifier apparatus comprises second water line 104. the elements of second water line 104 previously have been described. Additional elements of the humidifier apparatus include a humidifier manifold 156 and a water receiving line 158, which water receiving line extends from humidifier manifold 156 into hot air exhaust jacket 48 and upwardly to communicate with the outlet 112 of second water line 106. Humidifier manifold 156 comprises a plurality of laterally extending, hollow tubes 160. Tubes 160 are disposed within the same plane as perforated air delivery tubes 68 adjacent the bottom of the fireplace. Tubes 160 are supported in this position by hollow end pieces 162 and 164 to which tubes 160 are rigidly affixed, as by welding. Water receiving line 158, which is itself hollow, is affixed to end piece 164 on the side opposite to tubes 160. Upon activation of second valve 108, water will flow through second water line 104; will exit outlet 112; will enter water receiving line 158, will flow downwardly into hollow end piece 164; and thence will flow laterally through hollow tubes 160. It also will be obvious that any water so disposed in hollow tubes 160 will be heated whenever combustible material is burning in the fireplace. Experiments have shown that this water soon will be vaporized and, due to increased pressures within hollow tubes 160, will be forced backwardly through water receiving line 158. The water thus vaporized then will exit water receiving line 158 immediately adjacent outlet 112 where the vapor will be dispersed in the heated exhaust air flowing outwardly from exhaust jacket 48 through cover 32. These experiments also have shown that humidification of the air is accomplished very quickly and with great effectiveness.

The grate system for fireplace furnace 10 is shown in FIGS. 5*a*–5*d*. Grate 28 comprises, at its bottom portion, a conventional grate structure having depending front legs 166 and depending rear legs 168 joined by fore-and-aft extending horizontal pieces 170. The lower portion of grate 28 is rigidly interconnected by laterally extending horizontal pieces 172 welded to the underside of fore-and-aft pieces 170. The lower portion of grate 28 also includes a plurality of small, forwardly disposed, upstanding portion 24. Upstanding portions 24 partially restrain combustible material deposited on grate 28. It will be apparent from FIGS. 5*a*–5*d* that the lower portion of grate 28 straddles perforated air delivery tube 68 and humidifier manifold 156. This is desirable to prevent perforations 90 from becoming clogged with ash and to prevent perforated air delivery tube 68 and humidifier manifold 156 from coming into direct contact with burning combustible material in grate 28 so as to avoid damage thereto. The distance between the bottom of fore-and-aft pieces 170 and the top of perforated air delivery tube 68 and humidifer manifold 156 generally is unimportant, so long as direct contact therebetween does not occur.

Figure 5B:
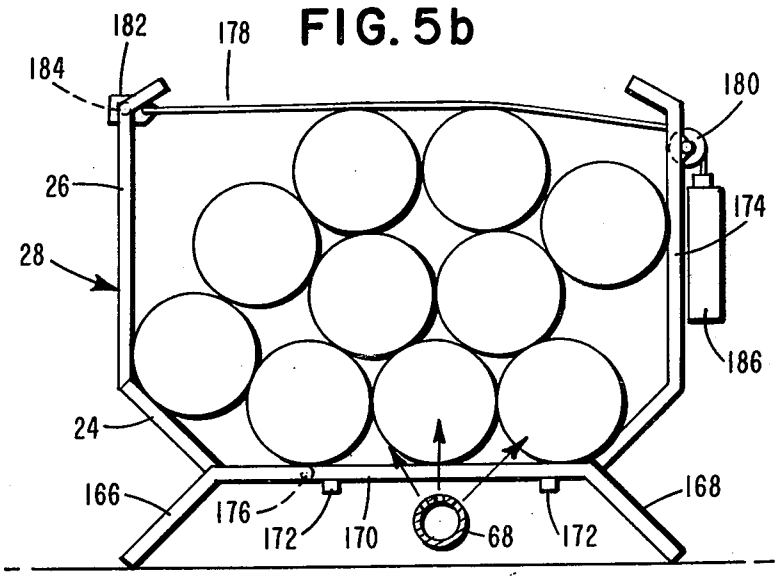
FIGS. 5*a*, 5*b*, and 5*c* are cross-sectional views of a grate according to the invention showing combustible material being loaded, as loaded, and as consumed.
Figure 5D:
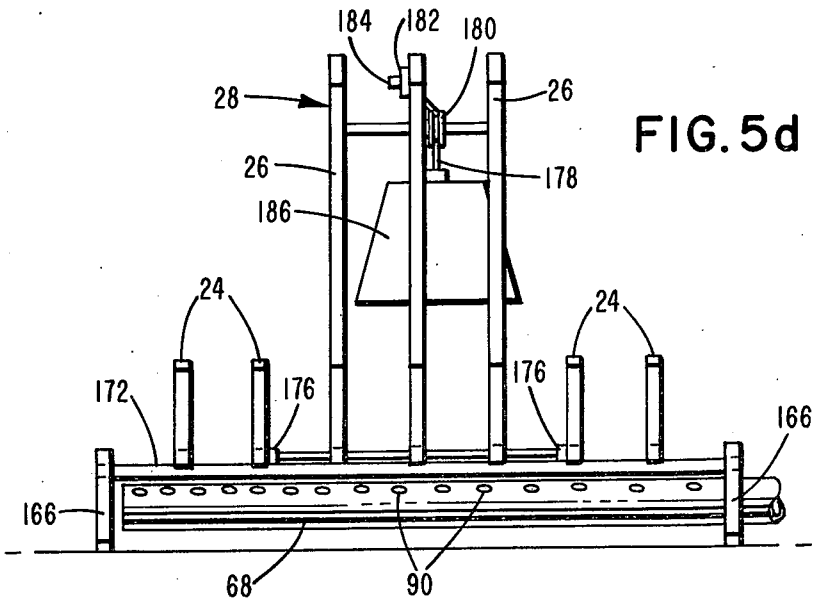
FIG. 5*d* is a front elevational view of the grate of FIGS. 5*a*, 5*b*, and 5*c*.
Figure 5A:
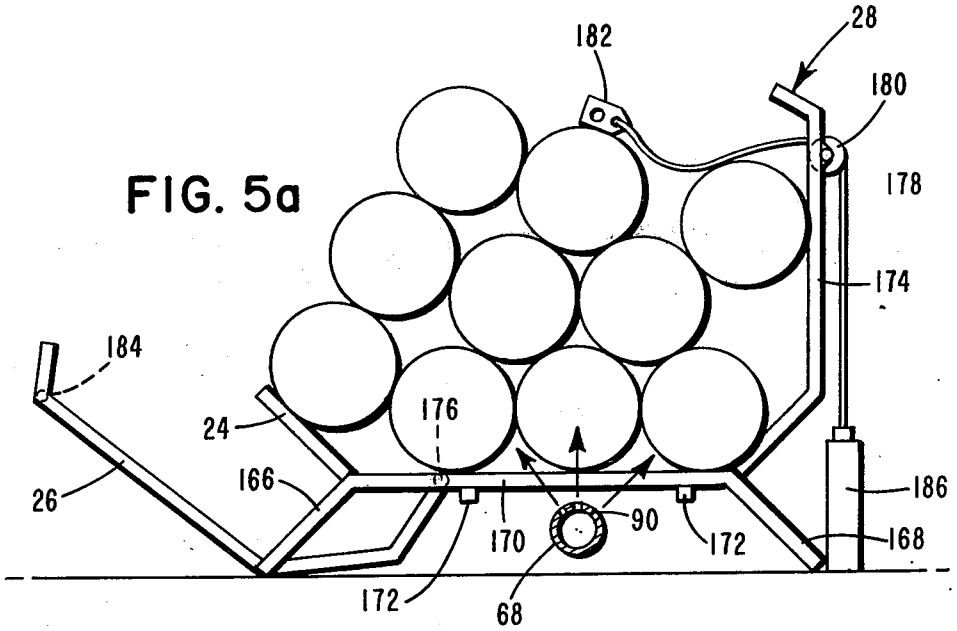
Figure 5C:
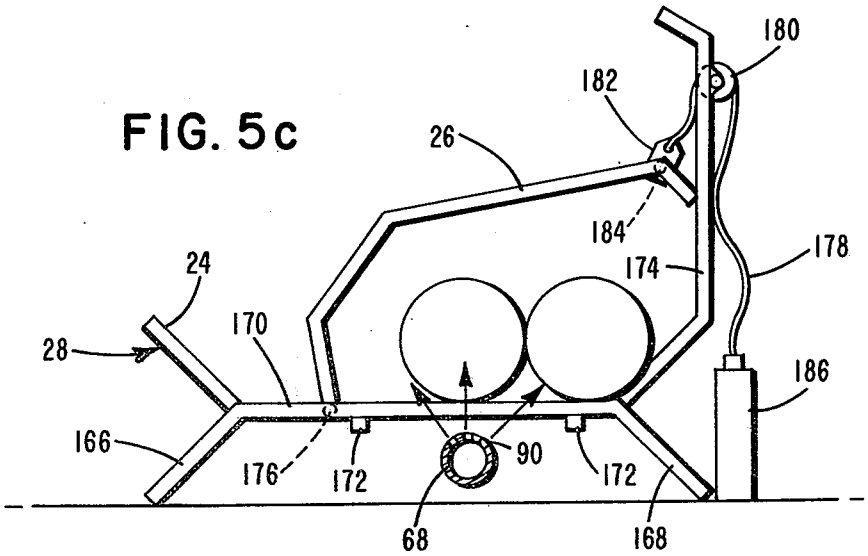

An unusual feature of the grate assembly is the large capacity of grate 28 as well as the efficient combustion facilitated by the compression of the combustible material. This is accomplished by means of movable, forwardly disposed, upstanding portions 26 and fixed, rearwardly disposed, upstanding portions 174. Since upstanding portions 26 and 174 are much higher than those found in conventional grates, a large quantity of combustible material may be loaded onto grate 28. Further, upstanding members 26 are rotatably mounted to grate 28 by hinge means 176. As a result, upstanding members 26 may be rotated counterclockwise as shown in FIG. 5*a* to facilitate loading of grate 28. Upstanding member 26 then may be rotated clockwise as combustion continues, in order to continually compress the combustible material for most efficient combustion. The movement of upstanding members 26 may be accomplished automatically by the apparatus shown in FIGS. 5*a*–5*d*. A cable 178 is disposed for movement about a pulley 180, which pulley is rigidly affixed to one of the upstanding members 174. The cable includes at one end a bracket 182, which bracket engages a pin 184 rigidly affixed to one of the upstanding members 26. A weight 186 is connected to the other end of the cable and, as best illustrated by FIGS. 5*b* and 5*c*, causes cable 178 to continually urge upstanding members 26 clockwise so as to compress combustible material previously placed on grate 28. It is to be understood that the cable mechanism herein described is illustrative only, and other well known mechanisms likewise could be used. For example, a heat-tempered spring could be wrapped about one of the fore-and-aft members 170 so as to bias upstanding members 26 in a clockwise direction about hinge means 176.

As indicated previously, a portion of the control system for fireplace furnace 10 comprises first thermostat 142 and second thermostat 146 having cam 152 associated therewith, which cam is disposed within housing 150. In turn, housing 150 is disposed immediately behind upper portion 38 of cover 30. Uppper portion 38 is easily removable to expose the forwardly facing side of housing 150 having control elements thereon. The uppermost element is an indicator light 188, shown in FIG. 2 and represented schematically in FIG. 7. Indicator light 188 is connected in parallel. with solenoid 76 in order to indicate when combustion air is being directed to perforated air delivery tube 68. The central element is a manually actuated switch 190 for controlling fans 118 and 120. The lowermost element is a manually actuated master switch 192 for energizing or deenergizing the control circuitry for the unit. Other control elements include solenoid 194 associated with first valve 98 and solenoid 196 associated with second valve 108. Solenoid 194 has a pair of electrical leads 198*a* and 198*b* extending therefrom. Similarly, solenoid 196 has a pair of electrical leads 198*b* and 200 extending therefrom.

Solenoid 194 is in series with a switch 202. The contacts of switch 202 are opened and closed by a cam follower 204 riding on the face of the cam 206. In turn, cam 206 is driven by gearmotor 208. Gearmotor 208 has a pair of electrical leads 210 and 212 extending therefrom. Electrical lead 210 is connected to a common ground wire 214 while electrical lead 212 is connected to one contact of switch 202. Electrical power is supplied to electrical lead 212 through a relay 216, which relay actuates a pair of contacts 218. It will be seen from FIG. 7 that whenever relay 216 is deenergized, normally open contacts 218 will be closed, thus supplying electric power to switch 202 and gearmotor 208. However, when relay 216 is energized, contacts 218 will open, thus cutting off electrical power to switch 202 and gearmotor 208. Relay 216 is electrically connected to ground wire 214 via electrical lead 220 and is connected to thermostat 142 via electrical lead 222.

One of contacts 218 is electrically connected to switch 202. The other of the contacts is electrically connected via electrical lead 224 to a pair of switches 226 and 228, each of which is supplied with line current of 110 Volts, 60 Hz. Each of the switches additionally has a cam follower 230 and 232, respectively, which cam followers ride on the face of cam 152. Upon rotation of cam 152, it will be apparent that cam follower 230 will cause the contacts of switch 226 to close, thus energizing the electrical circuitry of the unit via electrical lead 234. One lead of switch 228 comprises electrical lead 234, while the other lead of switch 228 comprises electrical lead 84*a* connected at its other end to solenoid 76.

Figure 7:
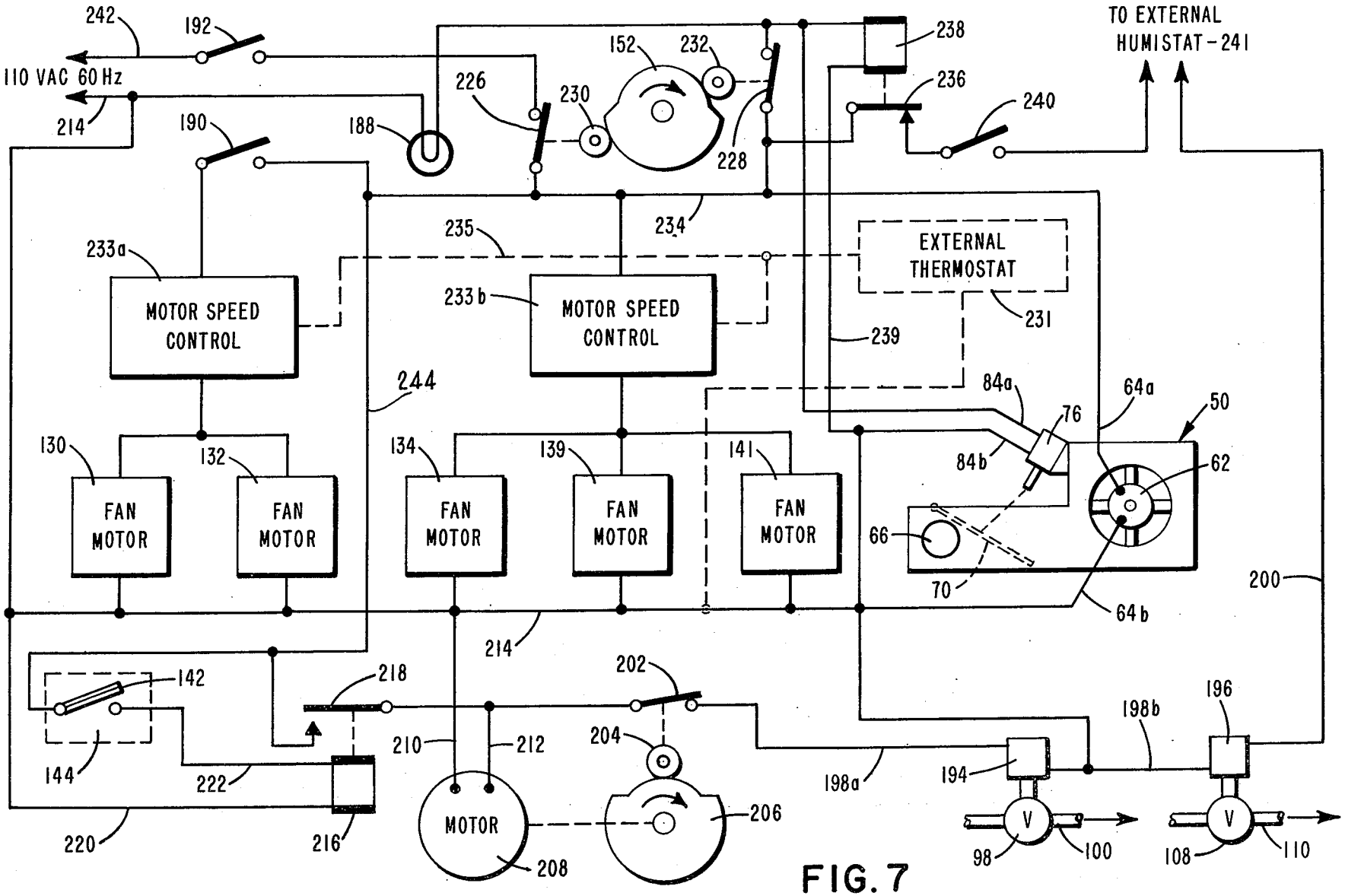
FIG. 7 is a schematic representation of electrical circuitry employed as part of the invention.

In order to automatically maintain a substantially constant furnace heat output, an external room thermostat 231 may be provided. Thermostat 231 is of any well known conventional design; consequently, thermostat 231 is not illustrated beyond that configuration shown in FIG. 7. Thermostat 231 is electrically connected to a pair of motor speed controls 233*a* and 233*b* via electrical lead 235. Motor speed controls 233*a* and 233*b*, in turn, are connected in series with fan motors 130, 132, 134, 139, and 141, as illustrated in FIG. 7. As with thermostat 231, motor speed controls 233*a* and 233*b* are of any well known conventional design. The relationship between thermostat 231 and motor speed controls 233*a* and 233*b* will be described hereinafter.

Electrical power for the humidifier apparatus is provided through a pair of normally closed contacts 236. When appropriate, contact 236 are opened by energization of relay 238. Relay 238 is connected to electrical lead 84*a* and is connected to ground wire 214 via electrical lead 239. Because relay 238 is connected to switch 228 via electrical lead 84*a* it is apparent that the humidifier apparatus will function as a result of the displacement of cam 152 having cam follower 232 riding thereon. Additionally, an override switch 240 is provided for the humidifer apparatus in cases where it is desired to prevent the automatic functioning of the humidifier apparatus. Further, a conventional room humistat 241 may be provided in series with switch 240 to permit the operator to automatically control the operation of the humidifier apparatus as a function of room air conditions.

OPERATION

A cycle is commenced by turning switch 192 to the ON position. This energizes the electrical circuitry of the invention through line wire 242 (110 Volts, 60 Hz) and line wire 214 (ground). Combustible material may be loaded onto grate 28 by disengaging bracket 182 from pin 184 and lowering upstanding members 26. Upon reattachment of these parts, the combustible material will be compressed thereafter as described previously. The combustible material may then be ignited and doors 16 closed to render the front, central portion of the fireplace substantially airtight. At this point in the cycle, cam 152 has not yet been rotated to that point shown in FIG. 7; therefore, the contacts of switch 226 are not yet closed and the unit is deenergized. This is indicated by the letter A on FIG. 8. In turn, solenoid 76 is deenergized and the previously mentioned spring bias forces damper 70 downwardly to direct any natural draft incoming air through opening 86 and into cold air intake jacket 44.

When the temperature within the fireplace reaches approximately 90° F, as sensed by thermostat 146, cam 152 will rotate to that position shown in FIG. 7. Switches 226 and 228 will close, permitting the rest of the system likewise to be energized. First, solenoid 76 will be energized to raise damper 70. Second, fan motors 62, 134, 139, 141 will be started. This means that air will be directed through duct means 50, opening 66, and into perforated air delivery tube 68 so as to provide a significant increase in the amount of combustion air available to burn the combustible material. Similarly, unheated intake air will be forced through cold air intake jacket 44, heat exchange tubes 46, and hot air exhaust jacket 48. At this point, the furnace is serving to heat the room and operation of the unit is in that portion of FIG. 8 indicated by the letter B.

As the fireplace temperature continues to rise, cam 152 will continue to rotate until the contacts of switch 228 are opened at about 200° F. This is indicated by the letter C on FIG. 8. Solenoid 76 will be deenergized and damper 70 will be displaced so as to shut off all air going to perforated air delivery tube 68.

With certain types of combustible material, the act of shutting off the supply of combustion air will be sufficient to cause the rate of combustion to decrease by itself. This situation is indicated by the letter D on FIG. 8. In such a case, the temperature within the fireplace would continue to fall until cam 152 has been rotated back to that position shown in FIG. 7 and indicated in FIG. 8 with the letter E as being approximately 150° F. By this system, an effective control over the rate of combustion is achieved and the heat outtput of the furnace will be substantially constant.

With different types of combustible material, however, merely stopping the flow of combustion air will not be sufficient to retard the rate of combustion. In this case, the temperature within the fireplace would continue to climb beyond that point shown by the letter D in FIG. 8. The resultant temperature rise is shown by the letter F in FIG. 8. It is quite possible that the temperature would continue to rise until certain elements of the furnace were damaged. This situation is avoided by the water quench system. When the temperature within the fireplace reaches approximately 250° F, as sensed by thermostat 142 (letter G in FIG. 8), gearmotor 208 is activated by the interaction of switch 202, relay 216, and contacts 218. Cam 206 is caused to rotate, which, in turn, causes switch 202 alternately to be opened and closed. When switch 202 is closed, solenoid 194 is energized to open valve 98 and send a flow of water through first water line 94 and thence onto the combustible material so as to reduce the rate of combustion. Because switch 202 is alternately opened and closed due to the shape of cam 206, water is directed onto the combustible material so as to reduce the rate of combustion. Because switch 202 is alternately opened and closed due to the shape of cam 206, water is directed onto the combustible material in pulses. The frequency of the pulses is governed by the speed of gearmotor 208, which is about 5 revolutions per minute, and the shape of cam 206. The water pulses will continue until the rate of combustion has slowed sufficiently to close thermostat 142.

In most circumstances, one activation of the water quench system is sufficient to keep the fireplace temperature cycling between 150° F and 200° F thereafter. However, if an excessively combustible material is being used, the system may repeatedly be activated to control the rate of combustion.

If the furnace is equipped with thermostat 231 and motor speed controls **233*a* and 233*b*, the furnace automatically will produce a substantially constant heat output. It is emphasized that even without the abovementioned elements, furnace 10 provides a much more uniform heat output than prior art furnace because of the combustion control system previously described. Assuming that thermostat 231 has been set at, for example, 68° F, motor speed controls 233*a* and 233*b* will increase the speed of the fan motor to which they are connected when the room temperature decreases to 67° F. Thus, the resultant increase in airflow will draw more heat from the furnace to further heat the room. On the other hand, if the room temperature should rise to 69° F, motor speed controls 233*a* and 233*b*** will decrease the speed of the fan motors to which they are connected so as to decrease the heat output of the furnace and thus cool the room.

Figure 8:
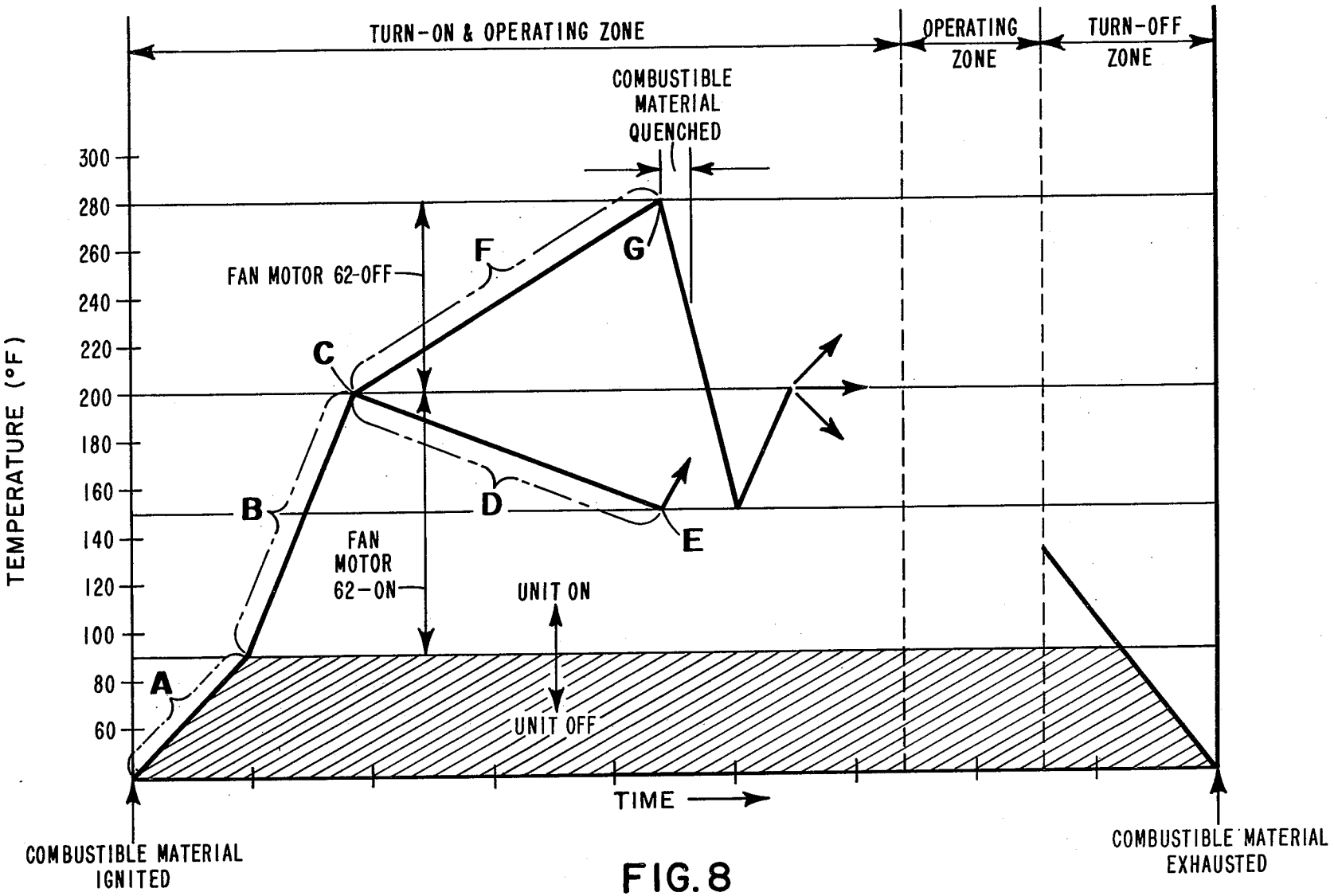
FIG. 8 is a graph depicting various operating modes of the furnace.

If it is desired to humidify the heated exhaust air, switch 240 is switched to the ON position. Water for the humidifying apparatus will flow through second water line 104 whenever valve 108 has been opened by solenoid 196. This is accomplished by relay 238 being deenergized which, in turn, is controlled by a switch 228. Since switch 228 runs off of cam 152, humidification will be obtained when the fireplace temperature, as sensed by thermostat 146, is between points C and G as indicated in FIG. 8.

In order to avoid humidification of the exhaust air when such humidification is not necessary, humistat 241 may be set at an appropriate level. When this level of humidification has been reached, solenoid 196 will be deenergized, thus closing valve 108 to stop the waterflow in second water line 104. It is pointed out that humistat 241 will function only if switch 240 is closed, thereby permitting switch 240 to override the entire humidifier apparatus.

Fans 118 and 120 are activated by turning switch 190 to the ON position. It is noted that the operation of these fans can be halted independently of thermostat 146 and thus can be employed by the operator to provide an increased airflow through the heat exchanger whenever such an increased airflow is desired. Normally, fans 118 and 120 will be used only when an additional heat output from the furnace is required.

It will be apparent that the present invention overcomes the difficulties associated with prior art fireplace furnaces and heat exchangers. Experiments have shown that the control over the rate of combustion is remarkably effective, being entirely automatic, and without concern once a fire has been started. Since a large amount of combustible material may be deeposited upon grate 28, and because the efficiency of the heat transfer system is so high, a small amount of combustible material will last for a longer period than heretofore known. For example, over an extended period of time, the furnace can heat a two-story house completely by itself, and yet consume only one average-size hardwood fireplace log per hour. Due to the sophisticated electrical control circuitry, the heat output of the furnace remains substantially constant. The water quench system functions effectively to prevent fireplace overtemperatures and the humidifier apparatus likewise is very efficient, as well as trouble-free.

While a specific embodiment of the invention has been described, it will be obvious to those skilled in the art that changes and modifications may be made without departing from the invention. It is therefore intended that the appended claims cover all such changes and modifications that fall within the true spirit of and scope of the invention.

I claim:

1. In a furnace having a grate disposed therein and a heat exchanger disposed about the grate, the improvement comprising:

a. at least one perforated air delivery tube in communication with said heat exchanger for supplying combustion air to said furnace;

b. duct means forming a part of said heat exchanger for supplying air to said perforated air delivery tube; and c. damper means in said duct means dor supplying air to said perforated air delivery tube for adjusting the amount of air communicated to said perforated air delivery tube, said damper means operating in response to predetermined temperatures existing within said furnace.

2. The apparatus of claim 1, wherein a. a plurality of perforations are formed in said perforated air delivery tube; and b. a fan is disposed in said duct means for forcibly supplying air to said perforated air delivery tube.

3. The apparatus of claim 2, wherein a. a restoring means is provided to bias said damper means; and b. an actuating means operating in response to predetermined furnace temperatures is provided to displace said damper means against said restoring means.

4. The apparatus of claim 1, wherein said heat exchanger additionally comprises:

a. a cold air intake jacket disposed adjacent one sidewall of said furnace;

b. a plurality of heat exchange tubes extending from said cold air intake jacket and communicating therewith;

c. a hot air exhaust jacket disposed adjacent the opposite sidewall of said furnace and in communication with said heat exchange tubes.

5. The apparatus of claim 4, wherein a. a plurality of perforations are formed in said perforated air delivery tube;

b. said duct means is disposed within said cold air intake jacket;

c. a first fan is disposed within said duct means for forcing air through said perforated air delivery tube and through said cold air intake jacket, heat exchange tubes, and hot air exhaust jacket;

d. a damper means is disposed within said duct means for adjusting air supplied to said perforated air delivery tube;

e. a restoring means is connected to said damper means to bias said damper means; and f. an actuating means is connected to said damper means to displace said damper means against said restoring means and operating in response to predetermined furnace temperatures.

6. The apparatus of claim 5, wherein said perforations in said perforated air delivery tube are so constructed and arranged as to provide a lesser airflow through that portion of said perforated air delivery tube proximate said cold air intake jacket and a great airflow through that portion of said perforated air delivery tube proximate said hot air exhaust jacket.

7. The apparatus of claim 5, including a. at least one second fan disposed within said cold air intake jacket to force air only through said cold air intake jacket, heat exchange tubes, and hot air exhaust jacket; and b. means for operating said second fan in response to predetermined furnace temperatures.

8. The apparatus of claim 7, including a. at least one third fan disposed within said cold air intake jacket to force air only through said cold air intake jacket, heat exchange tubes, and hot air exhaust jacket;

b. means for operating said third fan in response to predetermined furnace temperatures; and c. means for halting operation of said third fan independently of predetermined furnace temperatures.

9. The apparatus of claim 8 including means for operating said second fan and said third fan independently of predetermined furnace temperatures to achieve automatically a substantially constant furnace heat output.

10. The apparatus of claim 4, wherein a. a first water line is disposed within said cold air intake jacket and extends therefrom above said grate; and b. a plurality of perforations are formed in said first water line in that portion of said first water line extending above said grate.

11. The apparatus of claim 10, wherein a. a first valve is disposed in said first water line to control waterflow through said first water line; and b. a first valve control is provided for said first valve to control operation of said first valve.

12. The apparatus of claim 11, wherein a. a first thermostat is disposed within said furnace; and b. a switch is operatively connected between said first thermostat and said first valve control to cause said first valve to be opened to permit water to flow through said first water line upon said first thermostat sensing a predetermined maximum furnace temperature.

13. The apparatus of claim 12, wherein a. a second water line is disposed within said cold air intake jacket and extends through one of said heat exchange tubes into said hot air exhaust jacket; and b. a water receiving line is disposed within said hot air exhaust jacket in communication with the outlet of said second water line, said water receiving line disposed adjacent said grate to absorb heat therefrom.

14. The apparatus of claim 13, wherein a. a second valve is disposed in said second water line to control waterflow through said second water line; and b. a second valve control is provided for said second valve to control operation of said second valve.

15. The apparatus of claim 14, wherein a. a second thermostat is disposed within said furnace; and b. a switch is operatively connected between said second thermostat and said second valve control to cause said second valve to be opened to permit water to flow through said second water line upon said second thermostat sensing a predetermined furnace temperature.

16. The apparatus of claim 15, wherein a deflector is disposed within said hot air exhaust jacket to deflect air from said hot air exhaust jacket to said second thermostat.

17. The apparatus of claim 1 wherein said grate additionally comprises means for facilitating loading of said grate and continually compressing said combustible material comprising at least one movable, upstanding member disposed at the front of said grate.

18. A combustion control method for a furnace having a grate disposed therein and a heat exchanger disposed about the grate, comprising the steps of:

a. drawing unheated air into said heat exchanger;

b. diverting a portion of said unheated air from said heat exchanger past said grate to support combustion of combustible material disposed upon said grate;

c. adjusting the amount of air diverted from said heat exchanger past said grate in response to predetermined furnace temperatures; and d. quenching said combustible material to cool said combustible material in response to a predetermined maximum furnace temeprature.

19. The method of claim 18, comprising the addition step of quenching said combustible material at predetermined intervals.

20. A combustion control method for a furnace having a grate disposed therein, comprising the step of:

a. drawing unheated air into said furnace;

b. directing a portion of said unheated air past said grate to support combustion of combustible material disposed upon said grate;

c. adjusting the amount of air directed past said grate in response to predetermined furnace temperatures without adjusting the amount of unheated air drawn intosaid furnace; and d. quenching said combustible material to cool said combustible material in response to a predetermined maximum furnace temperature.

21. The method of claim 20, comprising the additional step of quenching said combustion material at predetermined intervals.

* * * * *